US005180219A

United States Patent [19]

Geddie

[11] Patent Number: 5,180,219

[45] Date of Patent: Jan. 19, 1993

[54] VEHICLE HEADLAMP ASSEMBLY

[75] Inventor: John D. Geddie, East Lansing, Mich.

[73] Assignee: General Motors Corporation, Detroit, Mich.

[21] Appl. No.: 739,968

[22] Filed: Aug. 5, 1991

[51] Int. Cl.[5] ..... F21M 7/00

[52] U.S. Cl. ..... 362/61; 362/267

[58] Field of Search ..... 362/61, 80, 267, 455

[56] References Cited

U.S. PATENT DOCUMENTS 4,329,738 5/1982 Heinz et al. ..... 362/61
4,574,338 3/1986 Takasaki et al. ..... 362/61
4,695,928 9/1987 Schauwecker et al. ..... 362/61
5,021,930 6/1991 Yamada ..... 362/61
5,072,348 12/1991 Tsukada ..... 362/61
5,091,830 2/1992 Suzuki ..... 362/61

*Primary Examiner*—Richard R. Cole
*Attorney, Agent, or Firm*—Edward J. Biskup

[57] ABSTRACT

A vehicle headlamp having a reflector housing member closed by a lens member which is snapped into locked engagement with the reflector housing member and serves to maintain the two members in a fixed relationship with each other during the curing of an adhesive located between the outer edges of the two members.

3 Claims, 2 Drawing Sheets

VEHICLE HEADLAMP ASSEMBLY

This invention concerns headlamps, in general, and more particularly relates to a vehicle headlamp in which the lens can be readily connected to the reflector housing without using separate fastener means for this purpose.

Certain current production headlamps having replaceable lamp bulb, use four metal clips for securing the lens to the reflector housing so as to maintain the parts together while the adhesive located between the lens and the housing is being cured. In addition to creating the problem for the assembler of handling four small additional parts for the assembly operation of the headlamp, one further problem presented by the use of separate metal clips for interconnecting the lens to the reflector housing is that the unattractive clips are at times visible from the front of the vehicle.

Accordingly, the objects of the present invention are to provide a new and improved headlamp for a motor vehicle in which the lens is secured to the reflector housing by means of a tongue and groove snap-lock arrangement; to provide a new and improved headlamp for a motor vehicle that utilizes a fastener means integrally formed with the lens and the reflector housing and wherein the lens is snapped into locked engagement with the housing; to provide a new and improved motor vehicle headlamp in which the lens and the reflector housing, are held together at the outer margins of each of the members, by a two piece snap lock fastener means and in which one piece of the fastener means is integrally formed with the housing and the other piece of the fastener means is integrally formed with the lens; and to provide a new and improved vehicle headlamp having a reflector housing closed by a lens which is snapped into engagement with the reflector housing and serves to maintain the two members in a fixed relationship during the curing of an elastomeric adhesive provided between the outer edges of the two members.

The above and other objects are realized in accordance with the present invention by a vehicle headlamp having a reflector member provided with at least one concave parabolic reflecting surface and having a front open face surrounded by a connector portion around the entire margin of the open face of the reflector member. A lens member closes the open face of the reflector housing and has a connector portion formed thereon that is complementary and conforming to the connector portion of the reflector member so as to provide a mating joint for an elastomeric sealant. In addition, fastener means, in the form of a tongue and groove arrangement, are integrally formed with the reflector member and the lens member adjacent the outer margin of each of the members and located at two or more opposed points along the outer margin of the headlamp for snap locking the members together during the curing of the sealant.

A more complete understanding of the present invention can be obtained from the following detailed description when taken with the drawings in which.

Figure 1:
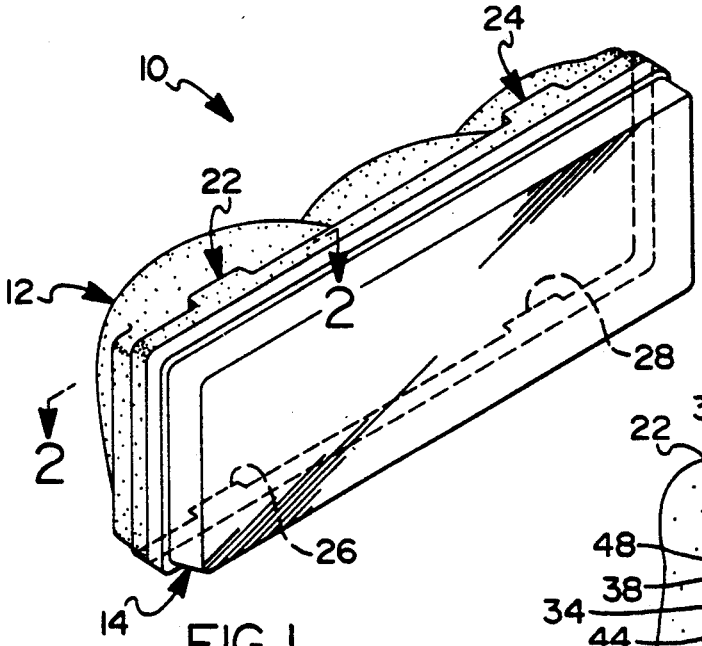
FIG. 1 is a perspective view of a headlamp assembly made in accordance with the present invention.
Figure 2:
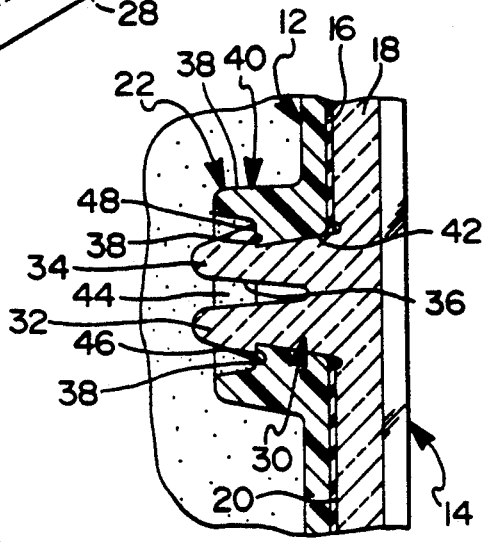
FIG. 2 is an enlarged sectional view taken on line 2—2 of FIG.1 showing one of the four fastener means used for snap locking the lens member to the reflector housing member of the headlamp assembly.
Figure 3:
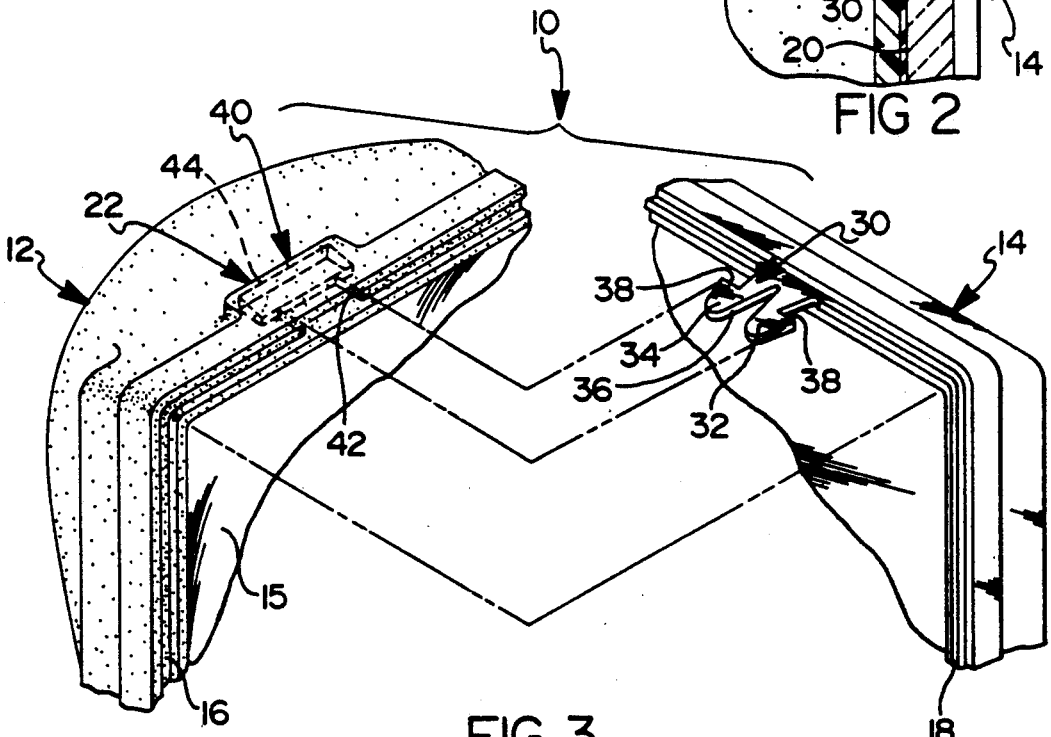
FIG. 3 is an partial isometric view showing the lens member and reflector housing member as seen in FIGS. 1 and 2 but separated from each other.

Referring now to the drawings and more particularly FIGS. 1-3 thereof, a vehicle headlamp 10 is shown having a the usual reflector housing member 12 the open front face of which is closed by a lens member 14. Both the reflector housing member 12 and the lens member 14 are rectangular in configuration and preferably are be made of a plastic material. The reflector housing member 12 is composed of multiple cavities each of which has an inner parabolic reflecting surface, such at indicated by reference numeral 15 in FIG. 3, for projecting a forwardly directed beam of light emanating at the filament of a replaceable light bulb (not shown). Thus, the cavities of the headlamp can provide a low beam, high beam and parking lamp illumination selected at the will of the driver.

As seen FIG. 3, suitable grooving or channeling 16 is provided around the entire margin of the open face of the reflector housing member 12 and complementary rib or ribbing 18 is provided around the entire margin of the lens member 14. The grooving and ribbing 16 and 18, in each instance, constitutes a connector portion provided on the lens member 14 and the reflector housing member 12. An adhesive and sealant 20 such as butyl is located in the channeling 16 of the reflector housing member 12 so when the aforementioned connector portions of the two members are joined together as seen in FIG. 1, the cavities of the reflector housing member 12 are sealed to prevent the ingress of foreign material into the body of the headlamp 10.

In this regard, it will be noted that in order to maintain the connector portions of the lens member 14 and the reflector housing member 12 in proper relative positions during the curing of the adhesive 20, four fastener means 22, 24, 26 and 28 are provided along the periphery of the headlamp 10 for locking the lens member 14 to the reflector housing member 12. Each of the fastener means 22-28 is identical in size and configuration and, as seen in FIG. 2 and 3, each fastener means 22-28 takes the form of a tongue and slot arrangement which serves to lock the lens member 14 to the reflector housing member 12.

More specifically, the tongue portion 30 of each of the fastener means 22-28 forms an integral part of the lens member 14 and, as seen in FIGS. 2 and 3, projects rearwardly from the peripheral horizontal section thereof above the ribbing 18 formed in the connector portion of lens member 14. The tongue portion 30 is planar in configuration and uniform in thickness and consists of a pair of interconnected barb-shaped elements 32 and 34 separated by a V-shaped gap or opening 36. The element 32 is a mirror image of the adjacent element 34 and each is generally J-shaped and includes a head section formed with a stop shoulder 38. The gap 36 between the elements 32 and 34 allows the latter to flex sideways as will be explained hereinafter.

The slot portion 40 of each of the fastener means 22-28 is an integral part of the reflector housing member 12 and is located at the front open face thereof above the channeling 16 formed in the connector portion and along a peripheral horizontal section of the reflector housing member 12. As seen in FIG. 2, the slot portion 40 has a tapered opening 42 constituting an entrance section which connects with an enlarged opening 44 constituting a lock section. The opening 44 of the slot portion 40 includes a pair of laterally spaced stop surfaces 46 and 48 and together with the opening 42 provides a through opening in the reflector housing member 12 for receiving the tongue portion 30 of the fastener means. In this regard, the openings 42 and 44 of the slot portion 40 have a vertical dimension slightly larger than the thickness of the tongue portion 30.

Thus, it should be apparent from the above description that during the assembly of the lens member 14 to the reflector housing member 12, adhesive will initially be provided in the form of a continuous bead in the connector portion of either the lens member 14 or the reflector housing member 12. Afterwards, the four tongue portions 30 of the lens member 14 will be aligned with the entrance sections or openings 42 of the four slot portions 40 on the reflector housing member 12. The lens member 14 will then be moved towards the open face of reflector housing member 12 causing the bifurcated elements 32 and 34 of each tongue portion 30 to move into the entrance section of associated slot portion 40. As the tongue portion 30 moves into the entrance section, the heads of the elements 32 and 34 engage the side walls of the opening 42 and, as a result, will be forcibly moved towards each other due to the tapered design of the entrance section and the gap 36 between the elements 32 and 34. Upon continued inward movement of the elements 32 and 34 into the accommodating slot portion 40, the stop shoulders 38 of the elements 32 and 34 will reach the stop surfaces 46 and 48 of the lock section of the slot portion 40 and as the elements 32 and 34 move beyond the stop shoulders 38 the built-in resiliency of the elements 32 and 34 will cause each to snap back to its normal positions at which time the shoulder 38 of each element 32 and 34 will engage the stop surface 38 in the lock section to lock the lens member 14 to the reflector housing member 12 as seen in FIG.2.

A modified form of tongue and slot fastener means described above is shown in FIGS. 4 and 5. It will be understood that the arrangement in FIGS. 4 and 5, although being different in design and configuration, is intended to serve the same purpose as the fastener means 22–28 seen in FIGS. 1–3. It will also be understood that those parts of the reflector housing member 12 and the lens member 14 seen in FIGS. 3 and 4 that are identical to the same parts of headlamp 10 of FIGS. 1–3 will be identified by the same reference numerals but primed.

Figure 4:
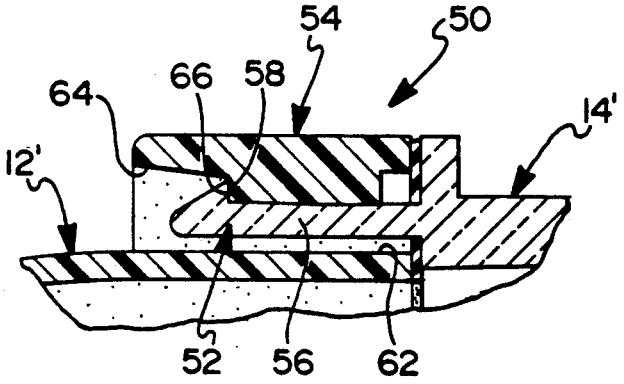
FIG. 4 is a sectional view of a modified form of fastener means for connecting the lens member to the reflector housing member.
Figure 5:
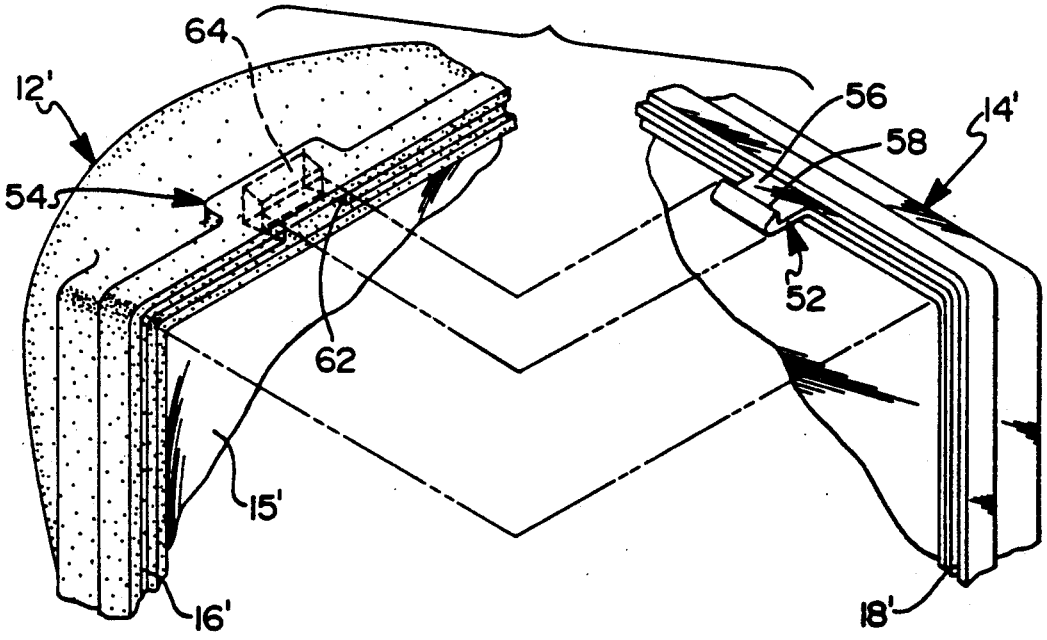
FIG. 5 is a view similar to that seen in FIG. 3 but showing the modified form of the fastener means seen in FIG. 4.

As best seen in FIG. 5, the modified fastener means 50 also consists of a tongue portion 52 and a slot portion 54 which serve to lock the lens member 14' to the reflector housing member 12'. In this case, the tongue portion 52 is comprised of a single rearwardly projecting element 56 that is integrally formed with the lens member 14' along the peripheral horizontal section thereof. The element 56 is of uniform thickness and terminates with a barb-like head formed with a stop shoulder 58. The normal position of the element 56 is as seen in FIG. 4, however, due to the resiliency of the plastic material from which the lens member 14' and the tongue portion 52 are formed, the element 56 is capable of having the head thereof bend or flex downwardly and return to the normal at-rest position of FIG. 4.

The accommodating slot portion 54 of the fastener means is an integral part of the reflector housing member 12' and is located along the periphery thereof along a horizontal section of the reflector housing member. The slot portion 54 consists of a through-opening having an opening 62 constituting an entrance section and a connecting opening 64 constituting a lock section. As seen in FIG. 4 the lock section is formed with a vertically orientated stop surface 66 so when the element 56 is inserted into the opening 62 or entrance section of the slot portion 54, the head will be deflected downwardly initially and as the head continues to move into the slot portion 54, it will maintain the deflected position until the stop shoulder 58 reaches the stop surface 66 at which time the element will snap upwardly into the locked position seen in FIG. 4 to lock the lens member 14' to the reflector housing member 12' and allow the adhesive located between the connector portions of the lens member 14' and reflector housing member 12' to cure.

Various modifications and changes can be made in the above-described headlamp fastener means arrangements without departing from the spirit of the invention. Such changes and modifications are contemplated by the inventors and they do not wish to be limited except by the scope of the appended claims.

The embodiments of the invention in which an exclusive property or privilege is claimed are defined as follows:

1. A vehicle headlamp comprising a reflector housing member provided with at least one concave reflecting surface and having a front open face having an outer margin surrounded by a connector portion around the entire margin of the open face of the reflector housing member, a lens member closing the open face of the reflector housing member and having a connector portion complementary and conforming to the connector portion of the reflector housing member, an elastomeric adhesive located between said connector portions of the reflector housing member and the lens member, a bifurcated tongue portion integrally formed with the lens member, the reflector housing member having a slot portion formed with a tapered entrance section and a lock section adjacent the outer margin of the open face of the reflector housing member, the tongue portion and the slot portion being located at two or more opposed points along the outer margin of the headlamp for snap-locking the members together during the curing of the adhesive.

2. The vehicle headlamp of claim 1 wherein the tongue portion is formed with a barb-like head provided with a stop shoulder for engaging a stop surface provided in the slot portion.

3. The vehicle headlamp of claim 1 wherein the tongue portion projects rearwardly from the lens member and is planar in configuration.

* * * * *